United States Patent [19]

Kramer et al.

[11] 4,102,151

[45] Jul. 25, 1978

[54] HOT GAS DEFROST SYSTEM WITH DUAL FUNCTION LIQUID LINE

[75] Inventors: Daniel Kramer, Yardley, Pa.; Israel Kramer, Trenton, N.J.; Harold Kramer, Morrisville, Pa.; Lawrence Board, Dallas, Tex.; Ram Chopra; William Micai, both of Trenton, N.J.

[73] Assignee: Kramer Trenton Company, Trenton, N.J. ; by said Israel Kramer, Harold Kramer, Larry Board, Ram Kumar Chopra and William Micai

[21] Appl. No.: 790,289

[22] Filed: Apr. 25, 1977

Related U.S. Application Data

[63] Continuation of Ser. No. 678,477, Apr. 20, 1976, abandoned.

[51] Int. Cl.[2] ..... F25B 47/00

[52] U.S. Cl. ..... 62/278

[58] Field of Search ..... 62/278, 196 B

[56] References Cited

U.S. PATENT DOCUMENTS

| | | | |
|---|---|---|---|
| 2,770,104 | 11/1956 | Sweynor | 62/278 |
| 3,392,542 | 7/1968 | Nussbaum | 62/278 |
| 3,427,819 | 2/1969 | Seghetti | 62/278 |
| 3,511,060 | 5/1970 | Bodcher | 62/278 |
| 3,636,723 | 1/1972 | Kramer | 62/278 |
| 3,665,725 | 5/1972 | Barlass | 62/278 |
| 3,822,562 | 7/1974 | Crosby | 62/278 |
| 3,838,582 | 10/1974 | Redfern | 62/278 |

OTHER PUBLICATIONS

Engineering Bulletin, RI-357A, Jul. 1975, Section "F"-Kramer Trenton Co.

*Primary Examiner*—Lloyd L. King

*Attorney, Agent, or Firm*—Daniel E. Kramer

[57] ABSTRACT

A compression type refrigeration system including at least one frosting evaporator positioned to refrigerate air. The evaporator has a liquid refrigerant inlet to which is connected an expansion valve. The evaporator also has a hot gas inlet; a liquid line supplies liquid to the expansion valve; a branch in the liquid line controlled by a solenoid valve connects to the hot gas inlet. The condensing unit, which includes compressor, condenser, receiver and re-evaporator, are valve-controlled so that during refrigeration, discharge gas from the compressor flows through the condenser, receiver, liquid line and expansion valve seriatim, but during defrost, gas from the compressor bypasses the condenser and flows instead from the compressor through the receiver, liquid line and hot gas inlet of the evaporator seriatim.

20 Claims, 4 Drawing Figures

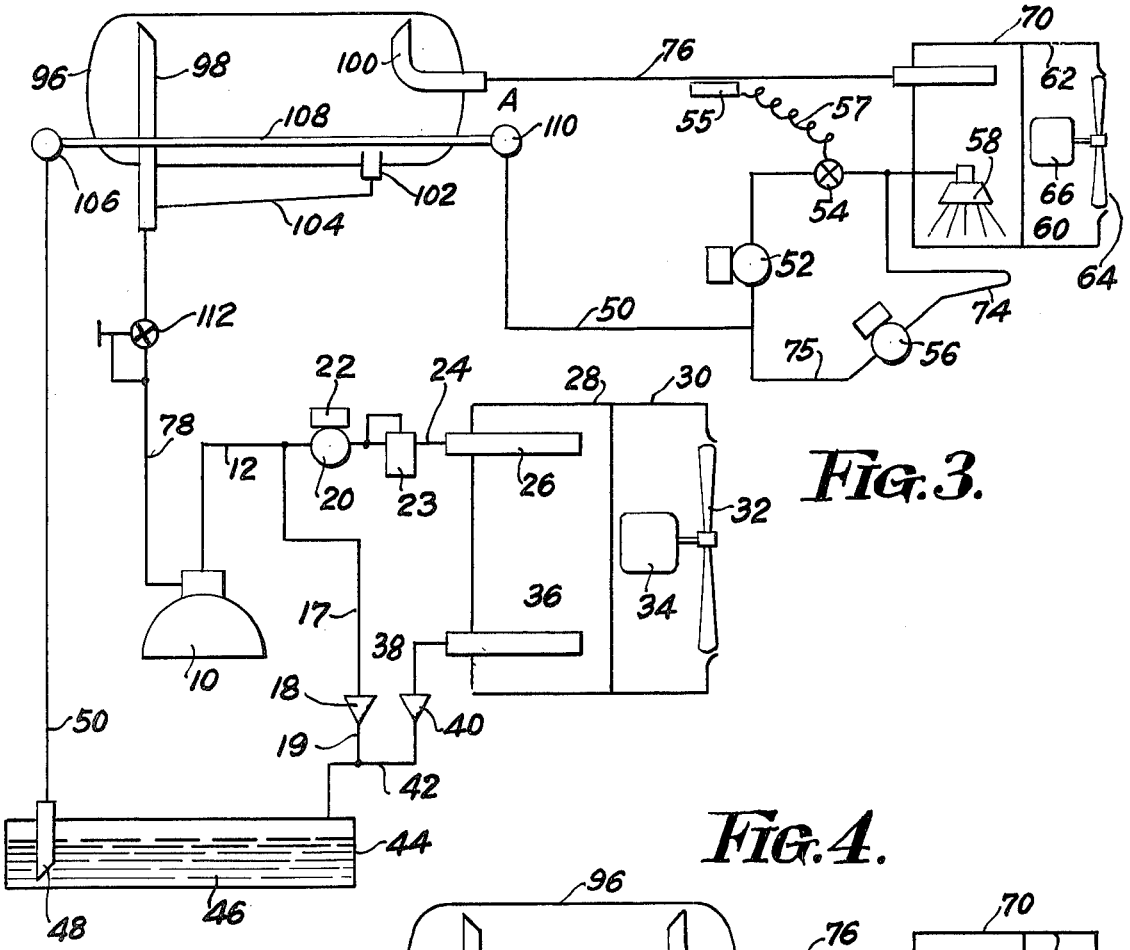
FIG. 3.
FIG. 4.
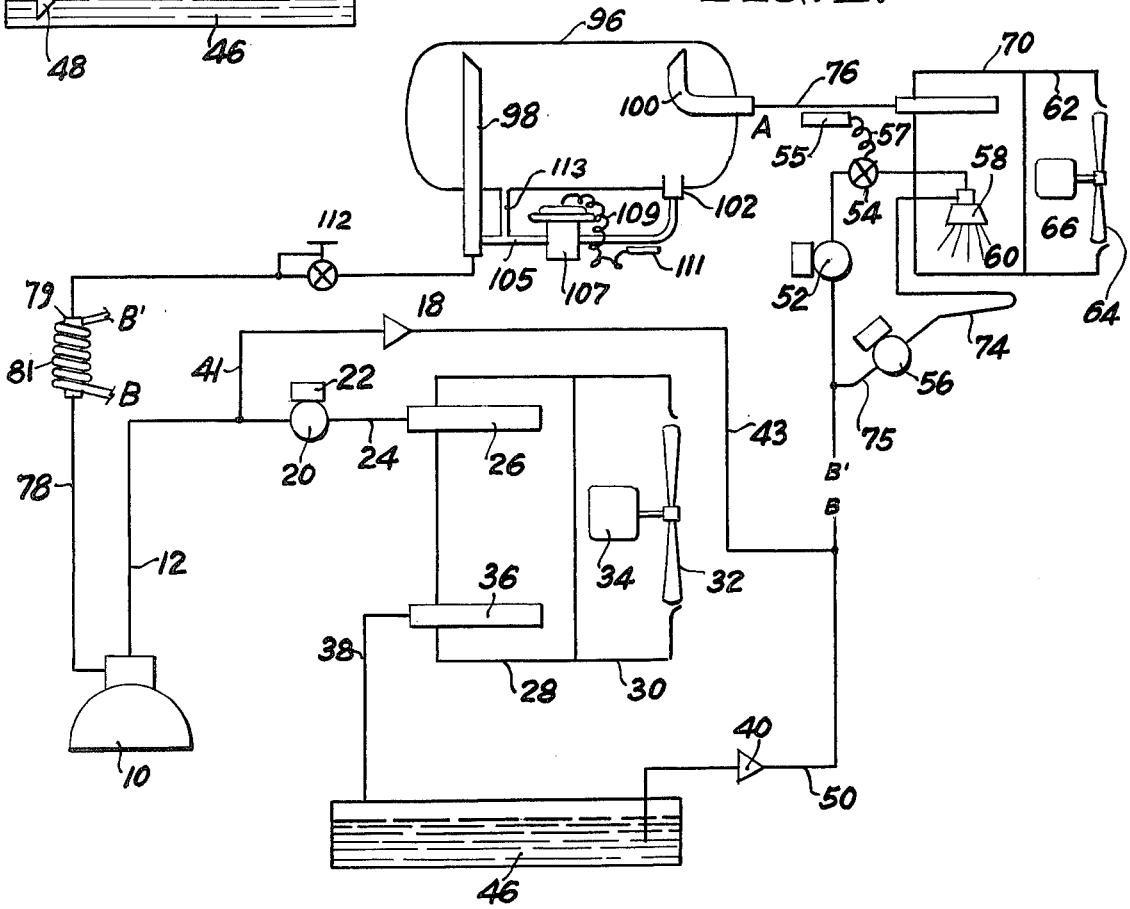

HOT GAS DEFROST SYSTEM WITH DUAL FUNCTION LIQUID LINE

This is a continuation of application Ser. No. 678,477, filed Apr. 20, 1976, now abandoned.

FIELD OF THE INVENTION

This invention relates to the field of mechanical refrigeration and further to the field relating to the periodic defrosting with hot gas of a frosted evaporator, and further to the field of hot gas defrosting in conjunction with air cooled systems employing uncontrolled condensers exposed to low ambients, and finally to the field of refrigeration systems for hot gas defrost which employ only two conduits connecting the high side with the evaporator, namely, a normally sized suction line and a normally sized liquid line.

PRIOR ART

Refrigeration systems utilizing air cooled condensers have long been known. More recently, refrigeration systems employing air cooled condensers exposed to the outdoor ambient have been developed which included controls for reducing the condenser capacity available so that the high side and liquid line pressure remained essentially constant throughout system operation at cold ambient conditions. These winter controlled systems have been applied to hot gas defrost evaporators and, in at least one case, as exemplified by U.S. Pat. No. 3,637,005, have included a valve controlled system where only two pipes, a suction line and a liquid line, need be used to connect the refrigeration high side with the evaporator. To this date, this inventor does not know of any refrigeration system employing an uncontrolled air cooled condenser intended to be subject to cold winter outdoor ambient and for year-round operation which has been offered with or is capable of providing hot gas defrosting for the evaporator.

BRIEF SUMMARY OF THE INVENTION

On refrigeration the compressor pumps discharge vapor to the condenser which condenses the vapor to a liquid, and in turn delivers the liquid to the receiver. From the receiver the liquid flows through the liquid line to the expansion valve, which lowers its pressure for evaporation in the evaporator. The vapor generated in the evaporator is conveyed back to the compressor via the suction line. During defrost, a solenoid valve at the inlet to the condenser closes, forcing vapor to flow directly to the receiver through a bypass provided for that purpose. A tee is provided in the liquid line near the evaporator and a solenoid-controlled branch is connected between the tee in the liquid line and the hot gas inlet to the evaporator. At the same time the discharge solenoid at the inlet to the condenser closes thereby forcing flow of discharge vapor to the receiver. The solenoid in the hot gas branch conduit connected to the hot gas inlet of the evaporator opens; thereupon the charge of liquid refrigerant in the receiver and in the liquid line is blown through the evaporator into the suction line, allowing the direct entry of hot gas to the evaporator via the compressor discharge, the condenser bypass, receiver, liquid line and hot gas branch conduit.

BRIEF DESCRIPTION OF THE DRAWINGS

FIG. 3 is a schematic diagram similar to FIG. 2 and adds a heat exchanged portion to the suction accumulator of FIG. 2.

FIG. 4 is a schematic diagram like FIG. 2 except that the terminus of the condenser bypass is in the liquid line at the receiver outlet instead of in the liquid line at the receiver inlet.

DETAILED DESCRIPTION

Figure 1:
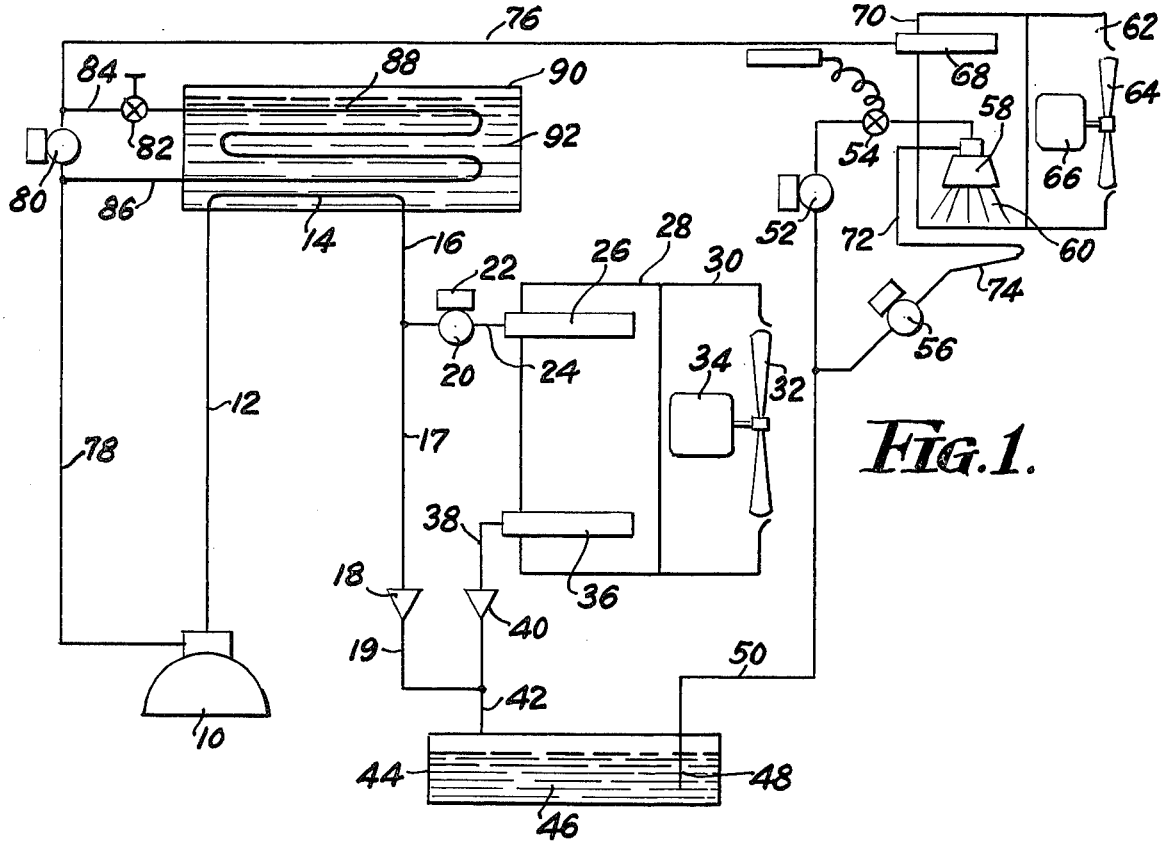
FIG. 1 is a schematic piping diagram of the system which includes the principle of the invention and has a heated re-evaporator interposed in the suction line to prevent return of liquid refrigerant to the compressor.

In FIG. 1, compressor 10 draws suction vapor from suction line 78 and delivers it compressed to a higher pressure into discharge line 12. The discharge vapor traverses heat exchange portion 14 which is immersed in a liquid heat storage for the purpose of defrost which will be described later and proceeds through conduit 16 toward the condenser 28. The vapor traverses open solenoid valve 20 which is controlled by coil 22 and enters the coil of air cooled condenser 28 through its inlet manifold 26. Air cooled condenser 28 is typically installed outdoors exposed to all ambients. It is sized sufficiently large to provide reasonable condensing temperatures during the highest expected summer ambients and has no controls associated with it for reducing or modulating its capacity during refrigeration (as distinct from defrost) operation. During both summer and winter, condenser coil 28 is cooled by air drawn over the coil by fan 32 which is driven by motor 34. Generally motor 34 is connected to turn off when compressor 10 stops operating. After the hot gas from the compressor discharge is condensed to a liquid in condenser coil 28, the liquid flows through the condenser outlet 36, outlet conduit 38 containing, check valve 40 and receiver inlet conduit 42 into the receiver 44 wherein it collects as a pool of liquid 46. As required, the liquid is withdrawn from the receiver via dip tube 48 and is delivered to the evaporator 70 by way of liquid line 50, liquid solenoid 52, liquid expansion valve 54 and distributor 58 with its distributing tubes 60. Within the evaporator the cold liquid refrigerant boils to a vapor, abstracting heat from the air drawn over the evaporator by fan 64, driven in turn by motor 66. The resulting suction vapor is delivered back to the compressor through suction line 76, open suction solenoid valve 80 and suction line 78 to compressor 10 for recycling. When the refrigerated space has become sufficiently cool, a thermostat, not shown, closes liquid solenoid 52, stopping the flow of liquid refrigerant to the expansion valve 54 and evaporator 70. The compressor 10 continues operation until the pressure in the low side of the system comprising the evaporator 70, suction line 76 and 78 and its associated piping are reduced to a sufficiently low pressure as determined by the setting of a low pressure switch and at that point the power to the compressor motor 10 is terminated and the compressor 10 stops operation. During refrigeration, hot gas solenoid 56 remains closed. When defrost is required, upon initiation by a time clock or any other means, the following events occur; suction solenoid 80 closes, discharge solenoid 22 closes, hot gas solenoid 56 opens, liquid line solenoid 52 closes. Fan motor 66 stops operation, compressor 10 continues operation, or, if has been off, the opening of the high side to the low side through hot gas solenoid 56 causes the pressure in the low side to rise and, in turn, causes the low pressure switch to close the contacts to the compressor motor, causing it to start operation. The compressor delivers vapor to discharge line 12, exchanger 14 and conduit 16. Solenoid valve 20 is closed. Therefore, vapor cannot enter condenser coil 28 and must instead push open spring loaded check valve 18. Spring loaded check valve 18 is constructed with an internal spring which prevents its opening until the pressure difference across it is 15 or more PSI. The vapor, flowing through conduit 19, now is at a pressure approximately 15 PSI lower than the pressure of the vapor in conduit 18. The pressure of the vapor now imposed directly on the liquid 46 in the receiver 44 acts to push the liquid out of the receiver through dip tube 48 and into liquid line 50, where it is allowed to flow in relatively unrestricted fashion, since hot gas solenoid 56 has opened and the liquid traverses evaporator 70, suction line 76 and accumulates ahead of holdback valve 82. After all the liquid stored in the receiver 46 and liquid line 50 has traversed the evaporator 70, it is followed by hot gas from the compressor discharge. At the moment that suction line solenoid 80 closes, the unrestricted source of vapor to the compressor 10 is cut off and holdback valve 82 begins to feed the liquid accumulated ahead of it into the re-evaporating coil 88, which is immersed in the warmed liquid 92. Recall that the liquid 92 had been warmed by continued operation of the compressor and, in turn, by the warming effect of the heat exchange relationship with the portion of the discharge line 14 in heat transfer contact with the liquid 92. As the holdback valve 82 feeds liquid refrigerant into the reevaporator coil 88, that liquid evaporates to vapor, absorbing heat from the liquid 92, at the same time cooling it. The vapor now flows to the compressor through re-evaporator outlet 86 and suction line 78. The holdback valve 82 is an outlet pressure regulator which is adjusted so that the pressure in suction conduit 78 is no higher than that which the compressor 10 can tolerate without overloading. A few moments after defrost begins, the pressure of the refrigerant in condenser coil 28 may be higher than or lower than the pressure of the refrigerant in receiver 44. If the defrost period follows a period when the compressor was not in operation, then pressure in the condenser would probably be lower than the pressure in the receiver 44. Therefore, there would be incentive for flow from conduit 42 at the inlet of the receiver to conduit 38 at the outlet of the condenser 28. However, check valve 40, positioned in conduits 38, 42, prevents flow from the receiver to the condenser under these conditions, and the defrost process proceeds just as if the condenser 28 were not present. If the system begins the defrost operation during a period that the compressor has been operating, then the pressure within condenser 28 may be higher than the pressure in receiver 44 after a few moments of operation. Under these conditions, the accumulated gas and liquid, which constitutes the operating charge of condenser 28, will be discharged from the condenser 28 into the receiver 44 until the two pressures are equal. At that time, the pressure in the receiver will continue rising and its pressure will surpass the pressure in the condenser. Check valve 40 will close, preventing any reverse flow and the defrost operation will continue with the condenser 28 isolated.

Figure 2:
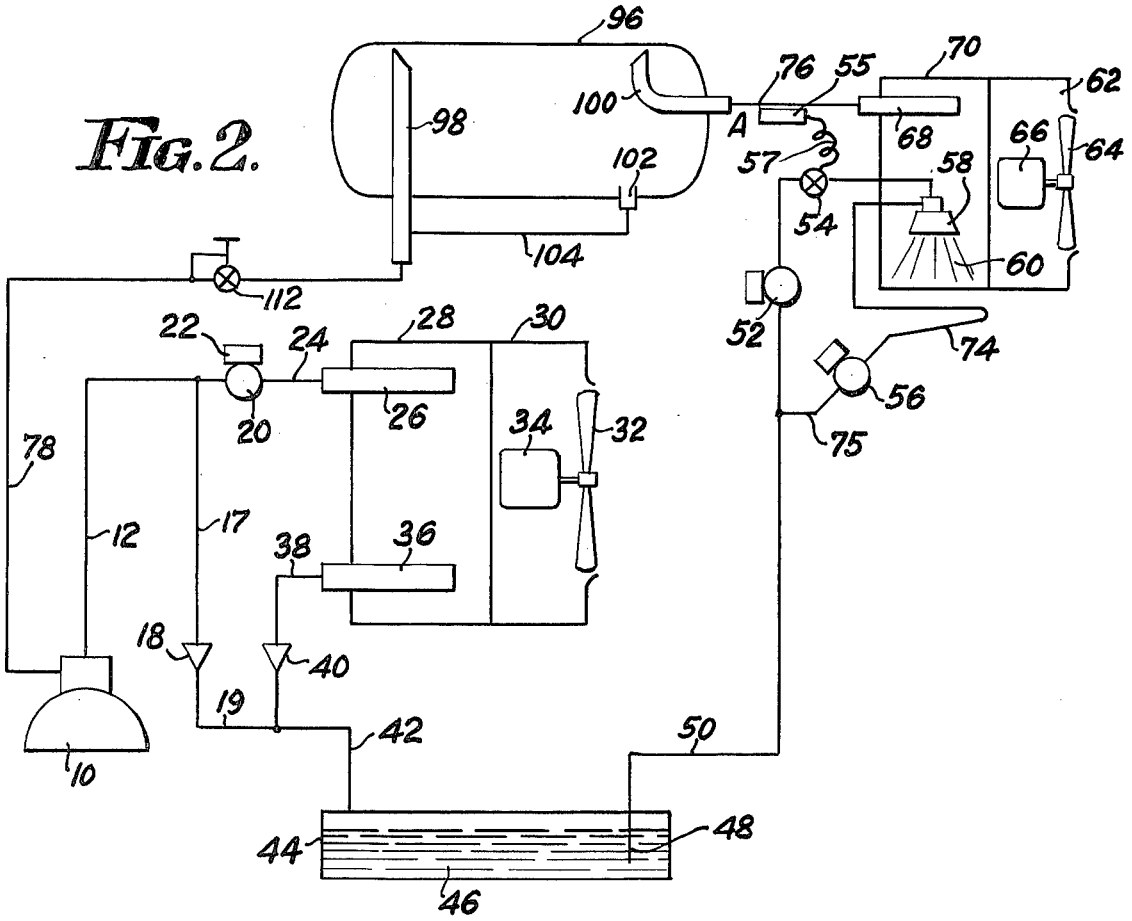
FIG. 2 is a schematic piping diagram of a refrigeration system embodying the principle of the invention which includes a suction accumulator in the suction line for catching liquid refrigerant returned through the suction line during the defrost and preventing the liquid refrigerant from reaching the compressor.

FIG. 2 illustrates the application of the invention to a refrigeration system which has no heat storage but instead has a suction accumulator in the suction line. On refrigeration cycles the compressor 10 withdraws vapor from suction line 78 and discharges it at higher pressure to discharge line 12, thence through open discharge solenoid 20 and into condenser coil 28, where the hot compressed refrigerant is condensed to a high pressure liquid which is delivered to receiver 44 via condenser outlet fitting 36, check valve 40 and receiver inlet conduit 42. As required, liquid refrigerant accumulated in the receiver 44 is delivered through liquid line 50, liquid solenoid 52 and thermal expansion valve 54 to evaporator 70 via distributor 58 and distributing tubes 60. In the evaporator 70 the refrigerant, whose pressure has been reduced, evaporates to a vapor and in so doing cools air drawn over the evaporator coil by fan 64, in turn driven by motor 66. The vapor and any entrained oil flows to suction accumulator 96, which is installed in suction line 76. In the accumulator any entrained oil is separated out and separately flows into outlet fitting 98 via liquid outlet 102 and restricted oil metering tube 104. Refrigerant vapor flows directly within the accumulator 96 from inlet fitting 100 to outlet fitting 98 and from the accumulator to the compressor for recompression via suction line 78. Holdback valve 112 is provided where the motor horse-power used to drive compressor 10 is insufficient to cause it to operate without motor overload under higher back pressure conditions. An alternate location for the holdback valve is at the inlet of the suction accumulator, designated by the letter A in suction line 76. Since it is intended that condenser 28 be installed outdoors, subject to all summer and winter conditions, it will be apparent that the condensing temperature in the high side, that is, the saturated temperature corresponding to the actual pressure, will be higher than the temperature of the air entering condenser coil 28 by a number of degrees we shall call T.D. For a given load and a given condenser the T.D. will be essentially constant under both summer and winter conditions. Under summer conditions, the pressure in the high side will be high; for example, with Refrigerant 502, 250–300 PSI; under winter conditions, the pressure in the high side will be relatively low, in the region of 80–100 PSI. Adequate flow of liquid refrigerant into evaporator coil 70 at low head pressure is achieved by proper selection of the port size in expansion valve 54 and proper arrangement of liquid line 50 so that essentially bubble-free liquid refrigerant can reach the inlet of expansion valve 54. U.S. Pat. No. 3,769,808 by Daniel Kramer describes winter operation of uncontrolled air cooled systems more fully.

In order to ensure wintertime defrost, it is necessary to isolate condenser 28 in order to eliminate any effect of the cold ambient air on the temperature of the refrigerant flowing from the compressor to the evaporator. This invention achieves this isolation by the use of discharge line solenoid 20 and condenser outlet check valve 40.

During defrost, discharge line solenoid 20 closes, hot gas solenoid 56 opens. The compressor withdraws vapor from suction line 78 and delivers it to discharge line 12. The vapor cannot flow to condenser inlet 26 since the discharge solenoid valve 20 is closed. The vapor therefore must push open spring-loaded check valve 18 and force its way through conduit 19 and 42 into the receiver 44 where it displaces and pushes accumulated liquid 46 through dip tube 48 and liquid line 50, hot gas branch conduit 75, hot gas solenoid 56, drain pan heating conduit 74, into and through evaporator 70 and into accumulator 96 where the liquid refrigerant is caught and collected. Some liquid can flow through outlet fitting 102 and metering tube 104. This controlled amount is reevaporated in suction line 78, which should be exposed to ambient temperature of 40° F or above. In the absence of such constant conditions, holdback valve 112 may be installed for the purpose of reducing the pressure and, therefore, the temperature of this small amount of liquid refrigerant which is returned to metering tube 104, thereby creating a temperature difference between the refrigerant and the air surrounding suction line 78, creating an incentive for heat flow from the air into the suction conduit and causing evaporation of the liquid refrigerant before it can reach the inlet of compressor 10.

FIG. 3 shows a schematic piping diagram of a system which is similar to FIG. 2, except that the suction accumulator has a conduit 108 located within it for the passage of high pressure liquid refrigerant from the receiver to the expansion valve and a condenser capacity control is provided. During refrigeration, the operation of the system is as follows: Compressor 10 withdraws refrigerant vapor from suction line 78, compresses it and discharges it at a higher pressure to discharge line 12. Vapor then enters condensing coil 28 through inlet pressure regulator 23 and discharge solenoid 20. Should the condensing pressure be lower than the minimum pressure for which regulator 23 is set, it will throttle, forcing some gas to bypass the condenser through bypass 17 and spring loaded check valve 18 and mix with the cold liquid leaving the condenser, warming it. This will serve to elevate the receiver and discharge pressure to the preset level, even when the ambient around the condenser 28 is very low. The operation of this type of control system is fully explained in U.S. Pat. No. 2,934,911 by Micai and Kramer. Solenoid 20 is always open during refrigeration. The high pressure refrigerant vapor is condensed to a liquid by transferring its heat to air drawn over condenser 28 by fan 32, which is driven by motor 34. The cooled, condensed liquid flows from the condenser coil 28 to its outlet fitting 36 through check valve 40 and then into receiver 44, where it collects as a pool 46. When the refrigerant is required to be used, it is withdrawn through dip tube 48 and flows through liquid line 50 to the high pressure liquid inlet fitting 106 of accumulator 96. From this fitting the liquid refrigerant flows through tubes 108, which are within the suction accumulator, and leaves via outlet fitting 110 to a continuation of liquid line 50, which serves to deliver the cooled liquid through liquid solenoid 52 and into expansion valve 54, which is under the control of bulb 55, strapped to suction line 76 and connected to the expansion valve by capillary tube 57. The expansion valve 54 serves to reduce the pressure and the temperature of the liquid refrigerant flowing therethrough to approximately the evaporating temperature of the system. At this temperature the liquid refrigerant withdraws heat from the air drawn over the coil by fan 64, driven by motor 66, and the liquid refrigerant is boiled away to a vapor. The vapor traverses suction line 76, enters suction accumulator 96 via its inlet tube 100 and leaves the suction accumulator via outlet connection 98, having during its passage therethrough partially cooled the liquid refrigerant flowing in heat exchange relation thereto through liquid conduit 108. The suction vapor from the suction accumulator is delivered to the compressor 10 via suction conduit 78. Under conditions where the compressor motor does not have sufficient power to operate the compressor under the high back pressure conditions which may result during defrost. Holdback valve 112 at the accumulator outlet throttles to maintain the pressure at its outlet at or below a predetermined setting. An alternate position for suction regulator 112 is at point A in suction conduit 76 at the inlet side of the suction accumulator. During defrost, discharge solenoid 22 closes; hot gas solenoid 56 opens. With discharge solenoid 20 closed, no discharge vapor can enter the condenser 28 through conduit 24. The vapor, therefore, is forced to bypass the condenser through bypass conduit 17 and spring-loaded check valve 18 to enter the receiver inlet conduit 42. No vapor can enter the condenser outlet 38 since check valve 40 in that conduit is oriented to allow flow from the condenser outlet 36 but to prevent reverse flow. The discharge vapor enters the receiver 44 and imposes its pressure on any liquid residing therein 46. Since the hot gas solenoid 56 has been opened, there is no barrier or restriction to flow and all the liquid in the receiver and in the liquid line 50 is pushed quickly through the evaporator 70, suction line 76 and enters the suction accumulator 96 where it resides temporarily. As a consequence of this rapid movement of the liquid, the receiver 44, liquid line 50, become conduits for the flow of hot gas from the compressor discharge, which now enters the evaporator 70, warming it and causing it to defrost. Any condensation resulting from cooling of the vapor in the cold evaporator 70 is transmitted through suction line 76 to the suction accumulator 96 where it is separated from the vapor flow. All the vapor entering suction accumulator 96 plus whatever vapor is formed therein is transmitted to the outlet conduit 98 of the suction accumulator and flows directly to the compressor through suction conduit 78 subject only to any pressure reduction from holdback valve 112, which is provided if necessary to prevent overload of the motor driving compressor 10. The structure of FIG. 3 is particularly effective where defrost must be achieved under conditions where the entire suction accumulator and high side have been exposed to low ambient conditions.

Thermodynamically the heat exchange relationship which occurs during defrost between the gas flowing from the compressor to the evaporator through heat exchange tube 108 and the liquid residing in the suction accumulator which surrounds heat exchange tube 108 does not add any heat to that which is available for the defrost, since the sole source of heat input under cold weather conditions is that provided by the energy of the motor acting on compressor 10 (and in suction-cooled hermetic compressors by the electrical losses of the motor which are absorbed by the refrigerant streams flowing over it.) However, the evaporative effect of the vapor flowing through heat exchange conduit 108 on the surrounding cold liquid generates a mass of vapor which is pumped by the compressor, adding to the total mass of vapor available for circulation, and therefore improving the transfer of heat from the compressor to the evaporator 70.

FIG. 4 is different from FIG. 2 in four ways:

A. Check valve 40 has been moved from the liquid line at the inlet of receiver 44 to the liquid line at the outlet of receiver 44.

B. The restricted metering tube 104 has been replaced with unrestricted drain tube 105 with valve 107 installed therein. Valve 107 is a thermal expansion valve with its bulb strapped on to tube 105 at the valve inlet. In another modification, valve 107 is a solenoid valve arranged to open during refrigeration cycles and to close during defrost and OFF cycles. Restrictor tube 113 is provided connecting the bottom of the accumulator tank 96 with the outlet connection 98, bypassing valve 107, so that a minimum quantity of liquid refrigerant can flow to suction line 78 whenever valve 107 is closed.

C. Condenser bypass 17, 18 and 19 is reconnected from a point in the liquid line 38 at the inlet to receiver 44 to a point in the liquid line 50 at the outlet of receiver 44 and the check valve 40.

D. A suction-liquid head exchanger, comprising suction tube 79 with liquid tube 81 in close heat transfer contact, is provided in suctin line 78. The portion 81 of the liquid line which is in thermal contact with suction tube 79 is connected into the liquid line 50 between the point of connection to the liquid line of condenser bypass 43/41 and the point of connection to the liquid line of hot gas branch 75. This point is represented on the drawing as B-B[1].

During defrost, hot gas solenoid 56 opens, discharge solenoid 20 closes, evaporator fan motor 66 is turned off, but compressor 10 continues to operate. Discharge vapor withdrawn by the compressor from suction line 78 is compressed and delivered to the discharge conduit 12. Since the discharge vapor cannot reach condenser 28 because discharge solenoid 20 has been closed, instead the vapor flows through conduit 41, spring load check valve 18 and conduit 43 directly into liquid line 50. The new position of check valve 40 in the liquid line of the outlet of the receiver 44 serves to prevent any backward flow of either liquid refrigerant or hot gas into the receiver or into condenser during the course of defrost. Consequently, the entire supply of compressed refrigerant vapor delivered by compressor 10 must flow through liquid line 50, the liquid tube 81 in heat relation with conduit 78 via connections B-B[1], hot gas solenoid 56, drain pan heating coil 74, distributor 58, distributor tubes 60, evaporator coil 70 and into suction accumulator 96. There any liquid which may have been entrained with the refrigerant vapor will be separated out and the liquid-free vapor will flow from inlet fitting 100 to outlet fitting 98 through suction holdback 112 and, at reduced and regulated pressure, through suction tube 79 of suction-liquid heat exchanger 79/81, and through suction line 78 back to compressor 10 for recycling.

Refrigerant liquid collected in accumulator 96 is prevented from reaching the accumulator outlet fitting 98 by virtue of any flow through liquid conduit 105 by thermal expansion valve 107, whose bulb 111 is clamped to conduit 105 at the inlet side of the expansion valve. The bulb is operatively connected to the expansion valve diaphragm by way of capillary tube 109. The thermal expansion valve is adjusted to be closed when its bulb senses about 5° superheat, and to be open when the bulb senses superheat over 5°. During the defrost or other periods, when liquid refrigerant has collected in suction accumulator 96, the bulb senses 0° superheat and causes thermal expansion valve 107 to be closed, shutting conduit 105 to the flow of liquid refrigerant. Conduit 113 bypasses valve 107 to allow small quantities of liquid refrigerant to flow from the accumulator 96 into suction line 78 for the purpose of facilitating defrost. The small amount of liquid refrigerant metered into the suction line by tube 113 is evaporated by passing in heat exchange contact with the hot gas stream traversing the liquid line portion 81 of the suction-liquid heat exchanger 79/81. When defrost is over, the liquid collected in accumulator 96 evaporates and meters slowly into the suction line 78 via restricted metering tube 113. Now this liquid is evaporated in heat exchanger 79/81 by heat exchange with the warm liquid flowing from receiver 44 through liquid portion 81 to expansion valve 54. When all the liquid in accumulator 96 has been drained or evaporated, bulb 111 no longer senses 0° superheat but instead senses a higher superheat, for instance, 15° superheat. At that time, valve 107 opens wide, allowing essentially unrestricted flow between the interior of tank 96 and accumulator outlet fitting 98, so that any oil entrained with the refrigerant vapor and separated therefrom in accumulator 96 will be able to flow unrestrictedly back to the compressor. In the alternate construction, when valve 107 is a solenoid valve, it is allowed to open when defrost is completed, or alternately the opening of the valve 107 may be delayed by a timer or other means until most of the liquid refrigerant collected in the accumulator during defrost has flowed out through restricted conduit 113.

The objective of connecting bypass line 41/43 with its control valve 18 to the liquid line at the outlet of the receiver, rather than the liquid line at the inlet of the receiver, as in FIG. 2, is to reduce the amount of refrigerant which accumulator 96 must contain during the course of the defrost and, therefore, allow a significantly smaller accumulator to be used. The system of FIG. 2 would be applied when a suction accumulator sufficiently large to contain essentially the entire operating charge in the system is supplied. By contrast, the system of FIG. 4 would be used when a more economical, smaller accumulator was desired to be used with the understanding that it could not contain the entire operating charge of the refrigeration system but only the charge which would flow into it under normal regular defrost conditions. In the event of some abnormal malfunction, such as failure of hot gas solenoid 56 to close, or failure of thermal expansion valve to control properly, then essentially the entire refrigerant charge contained in condenser 28, receiver 44, and liquid line 50 would attempt to deposit in accumulator 96 and if the reduced size accumulator applicable to the structure in FIG. 4 were in position, the accumulator would overfill and raw, liquid refrigerant would flow back to the compressor through suction line 78, possibly causing damage to the compressor.

During the refrigeration cycle, compressor 10 discharges compressed hot refrigerant vapor into its discharge line 12, by which it is conveyed into inlet 26 of condensor 28 by way of open discharge solenoid valve 20. Within condenser 28 the warm refrigerant vapor is condensed to a liquid and flows to receiver 44 by way of liquid line 38. The liquid 46 is conveyed to expansion valve 54 by way of liquid line check valve 40, liquid line 50, liquid conduit 81 portion of suction liquid heat exchangers 79/81, and liquid solenoid 52. The liquid refrigerant is expanded to a low pressure by the expansion valve 54 and is evaporated to dryness in evaporator 70 while performing its primary function of cooling the air drawn over the evaporator 70 by the fan 64, driven by motor 66. The refrigerant vapor flows through suction line 76 into suction accumulator 96 ouf of suction accumulator through its outlet fitting 98 to the compressor by way of suction line 78. Its flow is controlled by holdback valve 112, shown positioned at the outlet of the suction accumulator, but with a possible alternate position at its inlet at the position shown as A. The refrigerant vapor is warmed on its passage from the accumulator to the compressor by traversing suction liquid heat exchangers 79/81 and being brought in thermal contact with warm liquid refrigerant traversing liquid conduit 81 which is a portion of liquid line 50 connected thereto by connections B and $B^1$.

Although the invention has been shown in connection with certain specific embodiments, those skilled in the art will readily recognize that various changes in form and arrangements of parts may be made to suit individual requirements without departing from the spirit and the scope of the invention except as defined and limited by the following claims:

We claim:

1. An improved refrigeration system having refrigeration periods and defrost periods comprising a compressor having an inlet connection and a discharge connection; air cooled condenser means for exposure to summer and winter conditions, said condenser means having an inlet and an outlet; a first conduit connecting the compressor discharge and the condenser inlet; frosting and defrosting evaporator means having at least one inlet and a suction outlet; expansion means for feeding refrigerant liquid to an evaporator inlet; means for holding and conveying liquid refrigerant from the condenser outlet to the expansion means; a suction conduit connecting said suction outlet with the compressor inlet; wherein the improvement comprises:

(a) first valve means positioned in the first conduit for allowing flow to the condenser inlet during refrigerating periods and for positively preventing said flow during defrost periods;

(b) a hot gas conduit connecting the liquid conduit means with an evaporator inlet;

(c) second valve means for allowing flow in said hot gas conduit during defrost periods and for preventing said flow during refrigeration periods;

(d) a bypass conduit connecting the first conduit with the liquid conduit means;

(e) third valve means in the bypass conduit for allowing hot gas flow therethrough when said first valve means prevents flow to the condensor inlet and for preventing flow therethrough when said first valve means allows flow to the condenser inlet;

whereby hot gas is caused to positively bypass the condenser and to flow in the liquid conduit means during defrost periods.

2. A system as in claim 1 which includes a check valve having an inlet and an outlet in the liquid conduit means, said valve positioned to allow flow toward the expansion means and to prevent reverse flow, said bypass conduit connecting to the liquid conduit means on the outlet side of the check valve.

3. A system as in claim 2 where the liquid conduit means includes a receiver, said receiver having an inlet and an outlet.

4. An improved refrigeration system as in claim 3 where the bypass means conveys compressor discharge vapor from the first conduit to the receiver without passing through the condenser.

5. A system as in claim 3 where the check valve is in the liquid conduit connecting the receiver inlet.

6. A system as in claim 3 where the check valve is in the liquid conduit connecting the receiver outlet.

7. A system as in claim 2 which includes heat storage means for receiving liquid refrigerant from the evaporator and evaporating it.

8. A system as in claim 2 which includes tank means having vapor inlet means and vapor outlet means, said means being adapted to receive suction vapor and liquid refrigerant from the evaporator suction outlet and to allow the flow of the vapor to the compressor and to inhibit the flow of liquid.

9. A system as in claim 8 where the tank means includes a drain outlet and a drain conduit connecting the drain outlet with the vapor outlet means.

10. A system as in claim 8 in which the drain conduit includes a fixed restriction.

11. A system as in claim 9 which includes fourth valve means in said drain conduit.

12. A system as in claim 11 where the fourth valve means is adapted to sense the presence and absence of liquid refrigerant and to close in the presence of liquid refrigerant and to open in the absence of liquid refrigerant.

13. A system as in claim 12 where the fourth valve means is a thermal expansion valve.

14. A system as in claim 11 where the fourth valve means is a solenoid valve adapted to be open during refrigerating periods and closed during defrost periods.

15. A system as in claim 11 which includes flow means bypassing said fourth valve means and adapted to allow restricted liquid flow from the tank means to the vapor outlet.

16. A system as in claim 8 which includes heat exchange means at the vapor outlet means.

17. A system as in claim 16 where said heat exchange means is adapted to exchange heat between liquid refrigerant and suction vapor during refrigerating periods and between hot gas and suction vapor during defrosting periods.

18. A system as in claim 3 which includes capacity control means operative during refrigerating periods adapted to reduce the capacity of the air cooled condenser means and to maintain condenser and receiver pressures at or above a predetermined minimum.

19. An improved refrigeration system having refrigeration periods and defrost periods comprising:

(a) a compressor having an inlet and an outlet;

(b) air cooled condenser means for exposure to summer and winter conditions, said condenser means having an inlet and an outlet; a first conduit connecting the compressor outlet to the condenser inlet; first valve means positioned in said first conduit for allowing unrestricted flow to the condenser inlet during refrigeration periods and positively preventing said flow during defrost periods;

(c) frosting and defrosting evaporator means having at least one inlet and a suction outlet;

(d) expansion means for lowering the pressure of refrigerant liquid prior to flow through said evaporator inlet;

(e) second conduit means for conveying refrigerant liquid from the condenser outlet to said expansion means; check valve means having an inlet and an outlet located in said second conduit means for allowing flow from the condenser outlet and preventing reverse flow;

(f) hot gas conduit means for conveying liquid and gas from second conduit means to an inlet of said evaporator; second valve means for allowing flow through said hot gas conduit means during defrost periods and preventing said flow during refrigeration periods;

(g) a third conduit connecting said first conduit with said second conduit means, said third conduit bypassing said condenser, first valve means, and check valve means; third valve means in said third conduit for allowing hot gas flow therethrough when said first valve means prevents flow to the condenser inlet and for preventing flow through said third conduit when said first valve means allows flow to the condenser inlet; and (h) suction conduit means for connecting said suction outlet with the compressor inlet.

20. A system as in claim 2 which includes a liquid receiver located in the second conduit means.

* * * * *